United States Patent [19]

Fore et al.

[11] Patent Number: 4,648,446

[45] **Date of Patent: * Mar. 10, 1987**

[54] WIRELINE SET/TUBING RETRIEVE PACKER TYPE BRIDGE PLUG

[75] Inventors: William M. Fore; Kenneth D. Caskey, both of Duncan, Okla.

[73] Assignee: Halliburton Company, Duncan, Okla.

[ * ] Notice: The portion of the term of this patent subsequent to Oct. 8, 2002 has been disclaimed.

[21] Appl. No.: 750,557

[22] Filed: Jun. 27, 1985

[51] Int. Cl.[4] ..... E21B 23/06

[52] U.S. Cl. ..... 166/123; 166/134; 166/183

[58] Field of Search ..... 166/123, 134, 181, 182, 166/183, 192

[56] References Cited

U.S. PATENT DOCUMENTS

| | | | |
|---|---|---|---|
| 3,244,233 | 4/1966 | Villalon, Jr. | 166/123 |
| 3,507,327 | 4/1970 | Chenoweth | 166/134 |
| 3,584,684 | 6/1971 | Anderson et al. | 166/129 |
| 3,722,588 | 3/1973 | Tamplen | 166/182 |
| 3,749,166 | 7/1973 | Young | 166/123 |
| 4,044,826 | 8/1977 | Crowe | 166/182 |
| 4,078,606 | 3/1978 | Montgomery | 166/120 |
| 4,427,063 | 1/1984 | Skinner | 166/134 |
| 4,518,037 | 5/1985 | Youngblood et al. | 166/182 |
| 4,526,229 | 7/1985 | Dickerson et al. | 166/182 |
| 4,545,431 | 10/1985 | Fore | 166/183 |

*Primary Examiner*—Stephen J. Novosad
*Assistant Examiner*—William P. Neuder
*Attorney, Agent, or Firm*—James R. Duzan

[57] ABSTRACT

A packer type bridge plug for use in wells which may be set upon a wireline and retrieved upon a tubing string. The retrieval of the bridge plug is facilitated by the positive retraction of the upper and lower wedge members from beneath the slips during the retrieval process.

20 Claims, 9 Drawing Figures

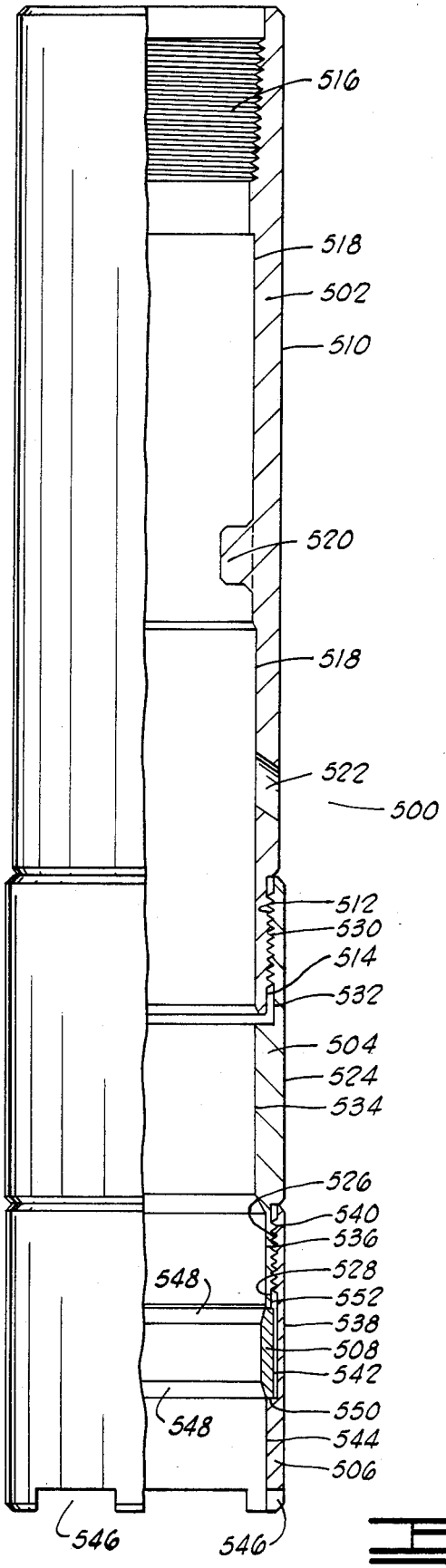
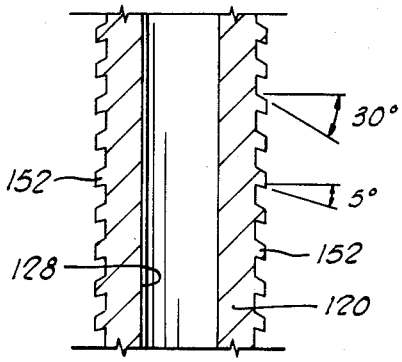
FIG. 5
FIG. 6

WIRELINE SET/TUBING RETRIEVE PACKER TYPE BRIDGE PLUG

BACKGROUND OF THE INVENTION

This invention relates to a bridge plug for use in wells. More specifically, this invention relates to a packer type bridge plug which may be set upon a wireline and retrieved upon a tubing string for use in wells.

In oil and gas wells it is desirable to have a bridge plug which will withstand high differential fluid pressures thereacross, can be set using a wireline and can be easily retrieved from the well.

Such a bridge plug is particularly desirable in wells where multiple formations are to be isolated for completion, testing and/or stimulation.

Some typical prior art retrievable packers and bridge plugs are disclosed in U.S. Pat. Nos. 3,244,233; 3,507,327; 3,584,684; 3,749,166; 4,078,606; 4,427,063 and in U.S. patent application Ser. No. 613,663, filed May 23, 1984, now U.S. Pat. No. 4,545,431.

STATEMENT OF THE INVENTION

The present invention is directed to a packer type bridge plug which will hold differential fluid pressure from either direction and may be set upon a wireline while being easily retrieved upon a tubing string. The easy retrieval of the bridge plug of the present invention is facilitated by the positive retraction of the upper and lower wedge members from beneath the slips during the retrieval process. The packer type bridge plug of the present invention comprises a J-slot retrieving mandrel, release valve sleeve, by-pass body, J-slot mandrel, ratchet body, upper shoe, packer elements, packer element spacer, lower shoe, packer mandrel case, packer mandrel, ratchet blocks, upper wedge member, slips, slip retainer sleeve, lower wedge member, and bottom coupling. Also shown are the bridge plug setting sleeve, adapter, tension stud, and the bridge plug retrieving tool for use in retrieving the bridge plug from the casing in the well bore.

BRIEF DESCRIPTION OF THE DRAWINGS

FIG. 5 is a view of a portion of the ratchet thread on the center mandrel of the present invention.

FIG. 6 is a view of the retrieving tool used to retrieve the present invention from a well.

DESCRIPTION OF THE INVENTION

Figure 1:
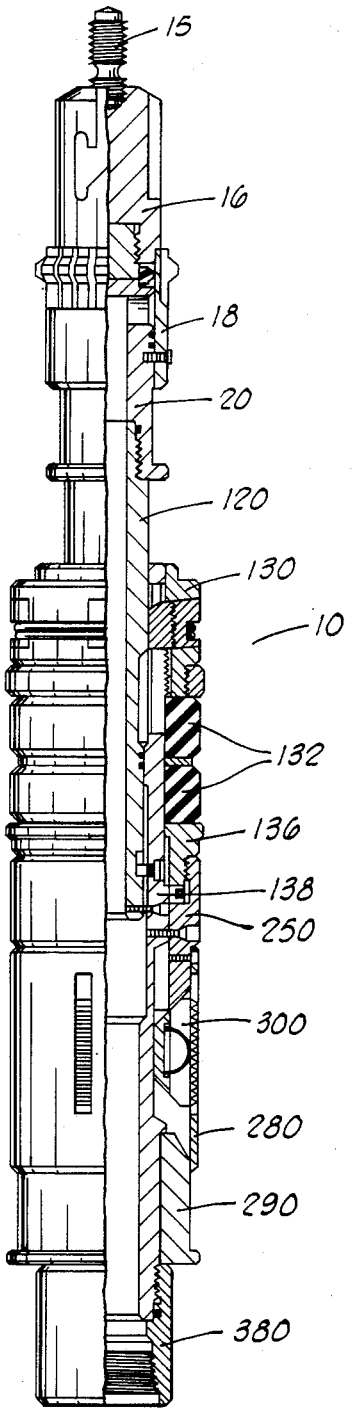
FIG. 1 is a quarter-sectional view of the bridge plug of the present invention.

Referring to FIG. 1, the bridge plug 10 of the present invention is shown.

As shown the bridge plug 10 comprises a tension stud 15, J-slot retrieving mandrel 16, release valve sleeve 18, by-pass body 20, J-slot mandrel 120, ratchet body 130, packer elements 132, packer mandrel case 136, packer mandrel 138, upper wedge member 250, slip retainer sleeve 280, lower edge member 290, slips 300 and bottom coupling 380.

The bridge plug 10 further includes other components and features which will be described hereafter.

Figure 2A:
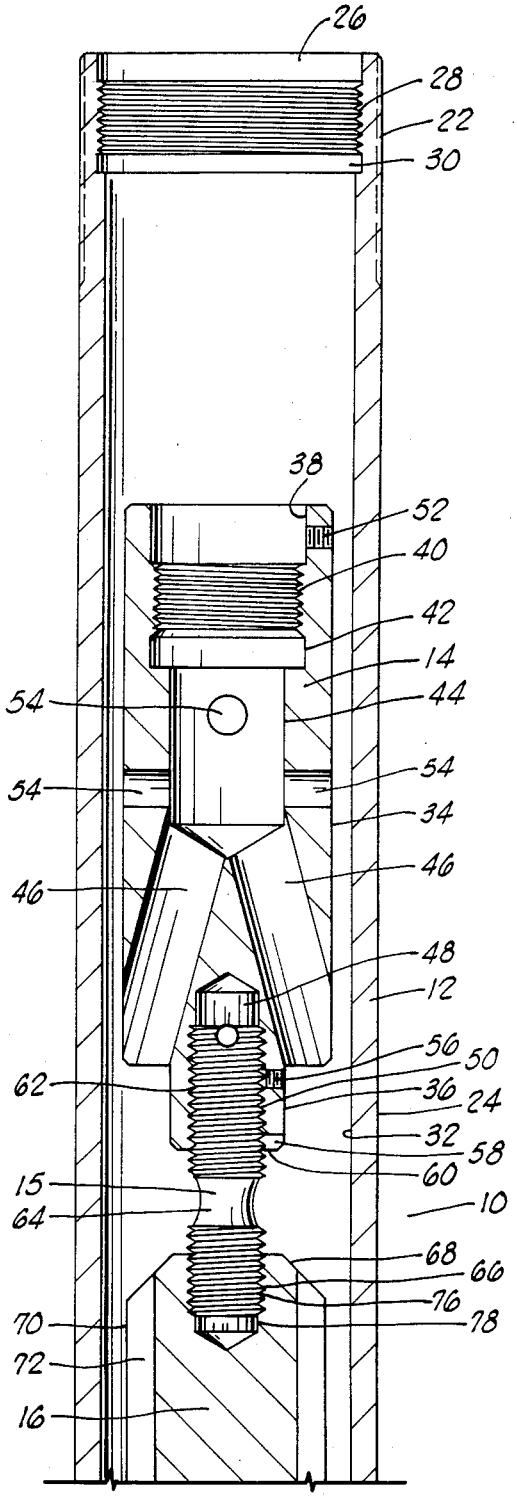
FIGS. 2A through 2D are cross-sectional views of the present invention.

Referring to FIG. 2A, a portion of the bridge plug 10 of the present invention is shown. Shown are a portion of the setting sleeve 12, adapter 14, tension stud 15, and a portion of the J-slot retrieving mandrel 16.

The setting sleeve 12 comprises an elongated annular cylindrical member having, on the exterior thereof, a plurality of wrenching flats 22 in exterior surface 24 and, on the interior thereof, first annular recess 26, threaded bore 28, second annular recess 30 and cylindrical bore 32.

The adapter 14 comprises a cylindrical member having, on the exterior thereof, first cylindrical exterior surface 34 and second cylindrical exterior surface 36 and, on the interior thereof, first annular recess 38, first threaded bore 40, second annular recess 42, first cylindrical blind bore 44, a plurality of longitudinal cylindrical bores 46 which allow fluid communication between bore 44 and the exterior of the adapter 14, second cylindrical blind bore 48 and second threaded bore 50. The adapter 14 further includes first threaded aperture 52, a plurality of apertures 54 which allow fluid communication between bore 44 and the exterior of the adapter 14, second threaded aperture 56, and annular recess 58 in the end 60 of the adapter 14.

The tension stud 15 comprises a cylindrical member having a first threaded end 62 which releasably threadedly engages second threaded bore 50 of adapter 14, a reduced diameter portion 64 and a second threaded end 66.

The portion of the J-slot retrieving mandrel 16 shown comprises a cylindrical member having, on the exterior thereof, frusto-conical annular surface 68 and first cylindrical surface 70 having, in turn, a plurality of J-shaped recesses 72 therein and blind bore 78 on one end thereof.

Figure 2B:
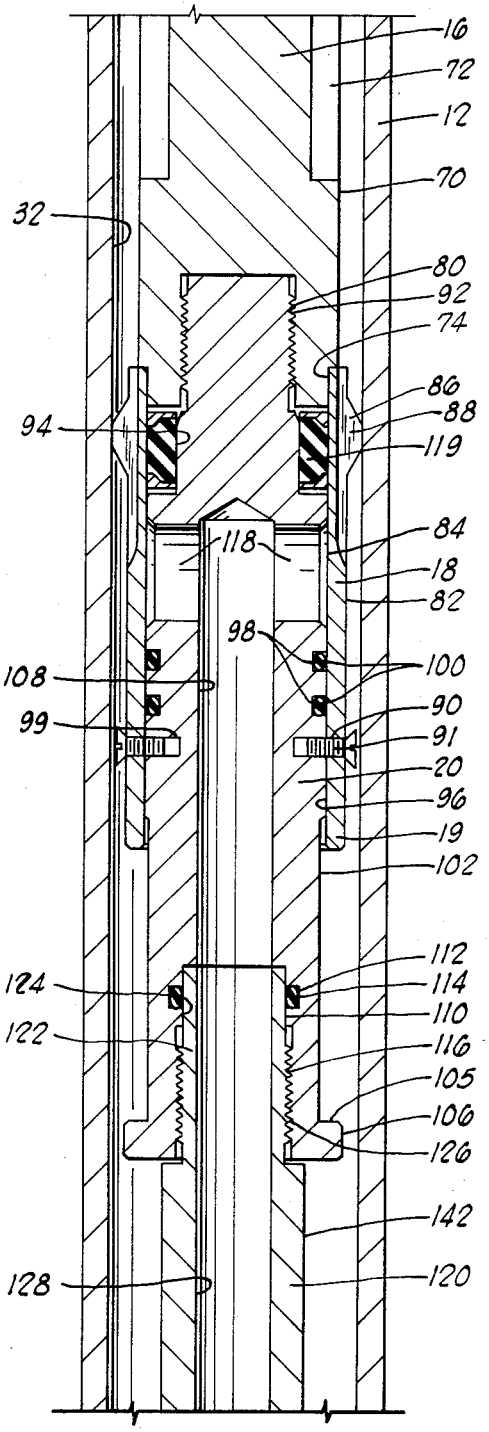

Referring to FIG. 2B, a further portion of the bridge plug 10 of the present invention is shown. Shown is the remaining portion of J-slot retrieving mandrel 16, release valve sleeve 18, by-pass body 20, a portion of J-slot mandrel 120 and a portion of setting sleeve 12.

The remaining portion of the J-slot retrieving mandrel 16 comprises an elongated cylindrical member having, on the exterior thereof, first cylindrical surface 70 having, in turn, a plurality of J-shaped recesses 72 therein, and second cylindrical surface 74 and, on the interior thereof, first threaded bore 76 which releasably, threadedly engages second threaded end 66 of tension stud 15, blind bore 78 and second threaded bore 80.

The release valve sleeve 18 comprises an elongated cylindrical annular member having, on the exterior thereof, cylindrical surface 82, on the interior thereof, bore 84, on one end, a plurality of longitudinal recesses or grooves 86, an annular rib 88 thereon and at least one threaded aperture 90 therethrough.

The by-pass body 20 comprises an elongated cylindrical member having, on the exterior thereof, threaded surface 92, first cylindrical surface 94, second cylindrical surface 96 having, in turn, a plurality of first annular recesses 98 therein containing annular elastomeric seals 100 therein which slidingly, sealingly engage bore 84 of release valve sleeve 18 and second annular recess 99, third cylindrical surface 102 and fourth cylindrical surface 106 and, on the interior thereof, blind bore 108, first bore 110 having, in turn, annular recess 112 therein containing annular elastomeric seal 114 therein and threaded bore 116. The by-pass body 20 further includes a plurality of apertures 118 which allow fluid communication between blind bore 108 and the exterior of by-pass body 20. Installed on first cylindrical surface 94 of by-pass body 20 is elastomeric member 119 which resiliently biases and sealingly engages the interior bore 84 of the end having annular recesses 86 therein of release valve sleeve 18 outwardly when sleeve 18 is retained in a first position on by-pass body 20.

The release valve sleeve 18 is releasably retained on release valve body 20 by a plurality of threaded shear pins 91 having a portion thereof threadedly engaging aperture 90 in sleeve 18 and having a portion thereof extending into annular recess 99 in release valve body 20.

Further shown in FIG. 2B is the upper end 122 of J-slot mandrel 120. The upper end 122 of J-slot mandrel 120 comprises a circular annular member having, on the exterior thereof, first cylindrical surface 124 which slidingly, sealingly engages seal 114 in first bore 110 of by-pass body 20, second cylindrical surface 142, and first threaded surface 126 which threadedly, releasably engages threaded bore 116 of by-pass body 20 and, on the interior thereof, bore 128.

Figure 2C:
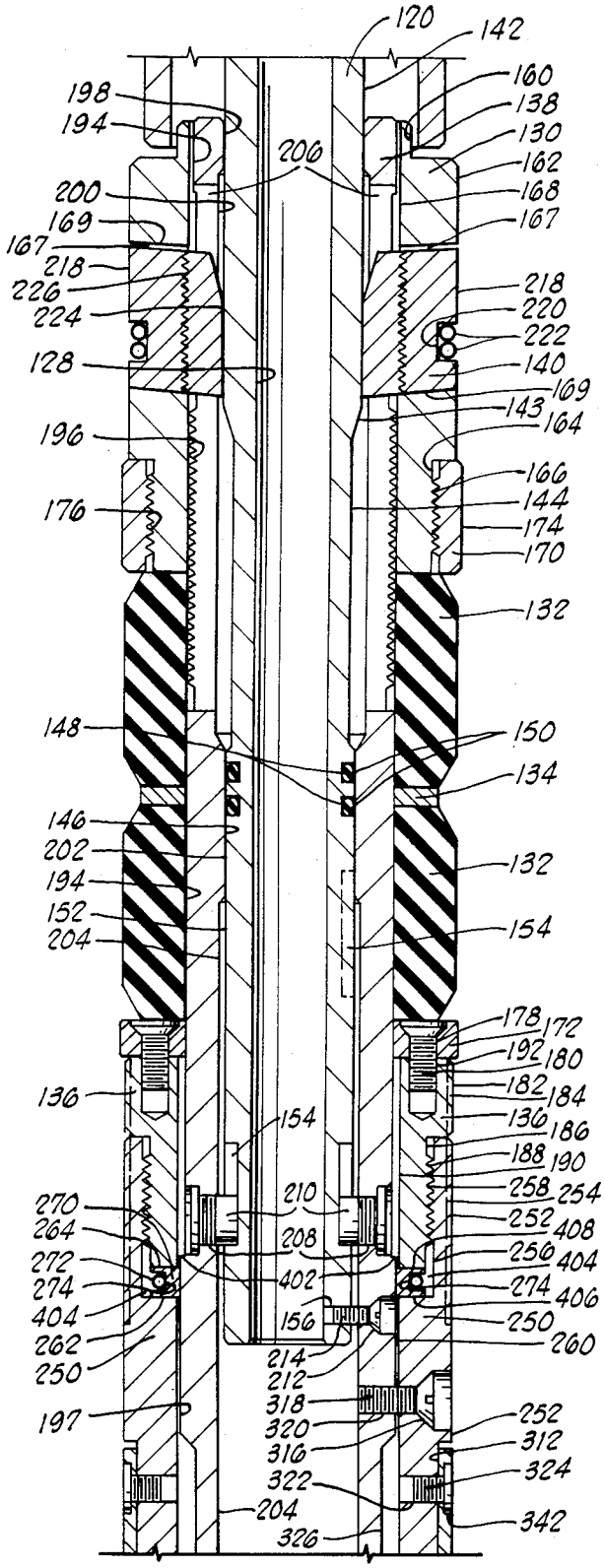

Referring to FIG. 2C, another portion of the bridge plug 10 of the present invention is shown.

Shown are the remaining portion of the J-slot mandrel 120, the ratchet body 130, packer elements 132, packer element spacer 134, packer mandrel case 136, a portion of packer mandrel 138, ratchet blocks 140, a portion of upper wedge member 250, upper packer shoe 170 and lower packer shoe 172.

The remaining portion of the J-slot mandrel 120 shown in FIG. 2C comprises an elongated cylindrical annular member having, on the exterior thereof, second cylindrical surface 142, frusto-conical annular surface 143, third cylindrical surface 144, fourth cylindrical surface 146 having, in turn, a plurality of annular recesses 148 therein containing annular elastomeric seal means 150 therein, and fifth cylindrical surface 152 having, in turn, J-slots 154 formed therein and at least one aperture 156 therein and, on the interior thereof, cylindrical bore 128 therethrough.

The ratchet body 130 shown in FIG. 2C comprises an annular cylindrical member having, on the exterior thereof, first cylindrical surface 160, second cylindrical surface 162, third cylindrical surface 164 and first threaded surface 166 and, on the interior thereof, bore 168 therethrough and a plurality of rectangular shaped apertures 167 therethrough having, in turn, angular bottom and, if desired, top end surfaces 169.

Each packer element 132 comprises an annular elastomeric member having a bore therethrough.

The packer element spacer 134 comprises an annular cylindrical member having a bore therethrough.

The upper packer shoe 170 comprises an annular cylindrical member having, on the exterior thereof, cylindrical surface 174 and, on the interior thereof, threaded bore 176 which releasably threadedly engages threaded surface 166 of ratchet body 130.

The lower packer shoe 172 comprises an annular cylindrical member having a plurality of apertures 178 therein, each aperture 178 receiving a portion of threaded fastener 180 therein.

The packer mandrel case 136 as shown comprises an annular cylindrical member having, on the exterior thereof, first cylindrical surface 182 having, in turn, a plurality of wrenching flats 184 therein, second cylindrical surface 186 and threaded surface 188 and, on the interior thereof, bore 190 therethrough and, in the upper end thereof, a plurality of threaded apertures 192, each aperture 192 releasably, threadedly receiving a portion of threaded fastener 180 therein.

If desired, the lower packer shoe 172 may be made an integral part of the packer mandrel case 136 thereby eliminating threaded fasteners 180 and apertures 178.

The portion of packer mandrel 138 shown in FIG. 2C comprises an elongated annular cylindrical member having, on the exterior thereof, first cylindrical surface 194, a plurality of ratchet groove surfaces 196 and second cylindrical surface 197 and, on the interior thereof, first bore 198, second bore 200, third bore 202 which slidingly, sealingly engages annular elastomeric seal means 150 in J-slot mandrel 120, and fourth bore 204. The packer mandrel 138 further includes a plurality of elongated slots 206 therethrough at least one or a plurality of apertures 208 of any desired shape such as circular, rectangular, etc., therethrough each of which, in turn, releasably receives a portion of threaded studs 210 therein having a portion thereof extending into J-slots 154 in J-slot mandrel 120 and at least one threaded aperture 212 which threadedly, releasably receives a portion of threaded shear pin 214 therein having a portion thereof extending into aperture 156 in J-slot mandrel 120.

Each ratchet block 140 comprises a rectangular shaped member having, on the exterior thereof, outer surface 218 having, in turn, rectangular recess 220 therein containing annular resilient annular garter springs 222 therein and, on the interior thereof, arcuate smooth surface 224 and arcuate ratchet groove surfaces 226 which is complementary to ratchet groove surfaces 196 on the packer mandrel 138. Each ratchet block 140 further includes angular end surfaces 228 which are complementary to bottom and, if desired, top angular end surfaces 169 of rectangular shaped apertures 167 of ratchet body 130.

As shown in FIG. 2C, the upper portion of the upper wedge member 250 comprises an annular cylindrical member having, on the exterior thereof, first cylindrical surface 252 having, in turn, a plurality of wrenching flats 254 therein and second cylindrical surface 312 and, on the interior thereof first bore 256, threaded bore 258 which is threadedly, releasably, complementary and secured to threaded surface 188 of packer mandrel case 136, and second bore 260. The upper wedge member 250 further includes at least one threaded aperture 316 extending through the member 250 from first cylindrical surface 252 releasably, threadedly retaining threaded shear pin 318 therein having, in turn, a portion thereof engaging aperture 320 in packer mandrel 138 and a plurality of threaded apertures 322 extending into the member 250 from second cylindrical surface 312 thereof. Each threaded aperture 322 threadedly, releasably receives a portion of threaded member 324 therein which releasably retains slip retainer sleeve 280 to the upper wedge member 250.

Retained between shoulder 262 of upper wedge member 250 and end surface 264 of packer mandrel case 136 is locking set dog 270. The locking set dog 270 comprises an annular cylindrical member comprising four arcuate segments having a locking set dog spring 272 retained within annular recess 274 in the exterior thereof to bias the locking set dog 270 into slidable engagement with the exterior of packer mandrel 138.

Figure 2D:
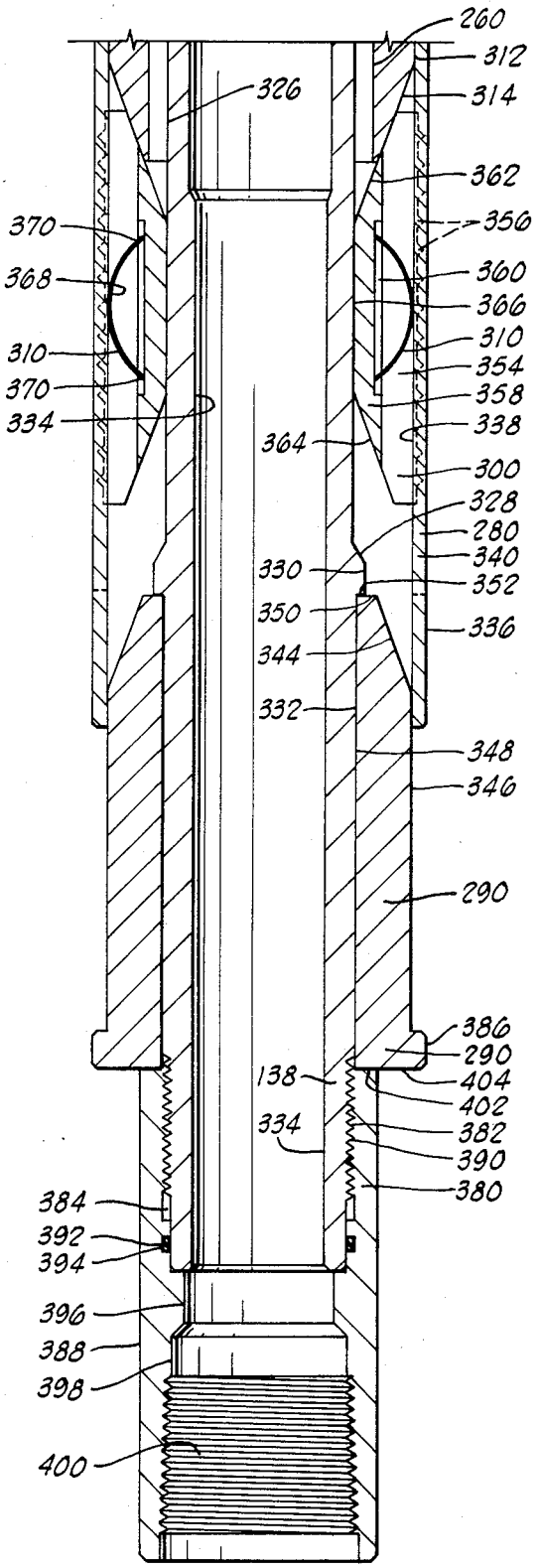

Referring to FIG. 2D, the remaining portion of the upper wedge member 250, the remaining portion of the packer mandrel 138, the slip retainer sleeve 280, the lower wedge member 290, slips 300, slip springs 310, and bottom coupling 380 are shown.

The remaining portion of the upper wedge member 250 comprises an annular circular member having, on the exterior thereof, frusto-conical surface 314 and, on the interior thereof, second bore 260.

The portion of the packer mandrel 138 shown in FIG. 2D comprises an elongated annular cylindrical member having, on the exterior thereof, third cylindrical surface 326, frusto-conical annular surface 328, fourth cylindrical surface 330, and fifth cylindrical surface 332, threaded surface 382 and sixth cylindrical surface 384 and, on the interior thereof, fourth bore 204, and fifth bore 334.

The slip retainer sleeve 280 shown in FIG. 2D comprises an elongated, annular cylindrical member having, on the exterior thereof, cylindrical surface 336 and, on the interior thereof, bore 338. The slip retainer sleeve 280 further includes a plurality of elongated rectangular apertures 340 therethrough and a plurality of apertures 342 each of which receives a portion of threaded member 324 therein to releasably retain slip retainer sleeve 280 to upper wedge member 250.

The lower wedge member 290 shown in FIG. 2D comprises an elongated, annular cylindrical member having, on the exterior thereof, frusto-conical annular surface 344 and first cylindrical surface 346, and second cylindrical surface 386 and, on the interior thereof, bore 348 which slidingly receives fifth cylindrical surface 332 of packer mandrel 138 therein having upper end surface 350 of the lower wedge member 290 abutting shoulder 352 of packer mandrel 138.

The slips 300 each comprise an arcuate rectangular shaped member having a rectangular raised center portion 354 having a plurality of teeth 356 thereon and, on each side of the raised center portion 354, a spring pad 358 having, in turn, a spring recess 360 therein. The upper 362 and lower 364 ends of each slip 30 are formed having frusto-conical arcuate surfaces which are complementary to and slidingly engage the frusto-conical annular surface 314 of upper wedge member 250 and frusto-conical annular surface 344 of lower wedge member 290, respectively. Each slip 300 further includes arcuate surface 366 which slidingly engages third cylindrical surface 326 of packer mandrel 138.

Each slip spring 310 comprises an arcuate resilient member having a middle portion 368 thereof engaging a portion of bore 338 of slip retainer sleeve 280 and the ends 370 thereof retained within spring recess 360 of spring pad 358 of slip 300 to resiliently bias slips 300 inwardly to retain each slip 300 within slip retainer sleeve 290.

The bottom coupling 380 shown in FIG. 2D comprises an elongated, annular cylindrical member having, on the exterior thereof, cylindrical surface 388 and, on the interior thereof, first threaded bore 390 which threadedly, releasably engages threaded surface 382 of packer mandrel 138, annular recess 392 containing annular elastomeric seal 394 therein, first bore 396, second bore 398 and second threaded bore 400.

If desired, the annular recess 392 containing annular elastomeric seal 394 therein may be deleted.

When installed on the end of packer mandrel 138, the bottom coupling 380 has upper end surface 402 thereof abutting bottom end surface 404 of lower wedge member 290 thereby causing upper end surface 350 to abuttingly engage shoulder 352 of packer mandrel 138.

Figure 3:
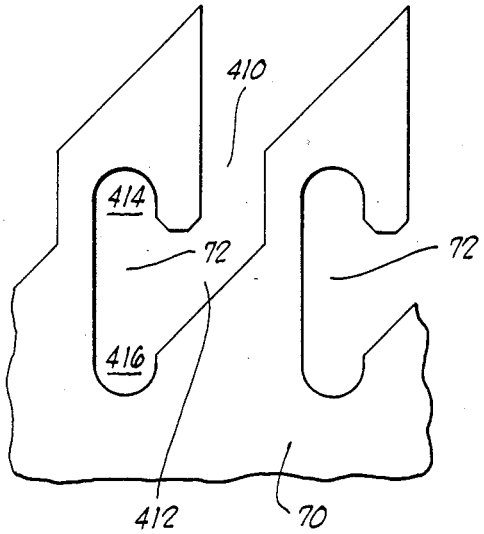
FIG. 3 is an unwrapped view of a portion of the J-slot configuration of the J-slot mandrel of the present invention which is used to retrieve the bridge plug.

Referring to FIG. 3, the J-shaped recesses 72 in the retrieving J-slot mandrel 16 are shown. Each J-shaped recess 72 is formed having entry portion 410, ramp portion 412, upper portion 414 and lower portion 416.

Figure 4:
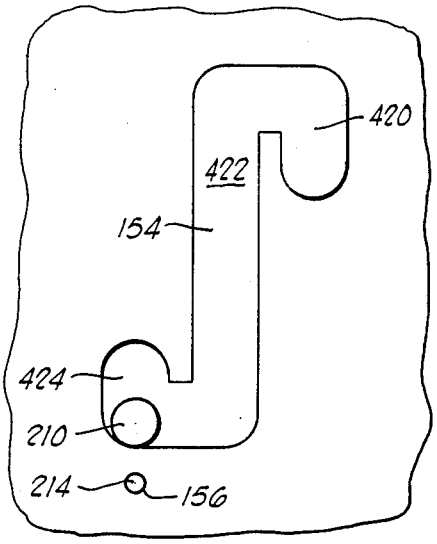
FIG. 4 is an unwrapped view of a portion of the J-slot configuration in one end of the J-slot mandrel of the present invention which is used to release the ratchets during the retrieval of the bridge plug.

Referring to FIG. 4, the J-slot 154 in J-slot mandrel 120 is shown. Each J-slot 154 is formed having an upper portion 420, transition portion 422 and lower portion 424.

Referring to FIG. 5, a portion of the threaded ratchet surface 196 on packer mandrel 138 is shown. The ratchet thread may be of any convenient pitch and diameter. A thread having a 30° angle with respect to the vertical plane of the leading face of the thread and a 5° angle with respect to the vertical plane of the trailing face of the thread is preferred. The arcuate threaded surface 226 of the ratchet blocks 140 are similarly formed.

Referring to FIG. 6, the retrieving tool 500 for the retrieval of the bridge plug 10 of the present invention is shown.

The retrieving tool 500 comprises an overshot member 502, upper ring spring holder 504, lower ring spring holder 506 and ring spring 508.

The overshot member 502 comprises an elongated cylindrical annular member having, on the exterior thereof, first cylindrical surface 510, threaded surface 512, and second cylindrical surface 514 and, on the interior thereof, threaded bore 516 and bore 518 having, in turn, a plurality of lugs 520 located thereon. The overshot member 502 further includes a plurality of apertures 522 to allow fluid communication from the exterior thereof to the interior thereof.

The upper ring spring holder 504 comprises an elongated cylindrical annular member having, on the exterior thereof, first cylindrical surface 524, threaded surface 526 and second cylindrical surface 528 and, on the interior thereof, threaded bore 530 which threadedly, releasably engages threaded surface 512 of overshot member 502, first bore 532, second bore 534 and third bore 536.

The lower ring spring holder 506 comprises an elongated cylindrical annular member having, on the exterior thereof, cylindrical surface 538 and, on the interior thereof, threaded bore 540, first bore 542 and second bore 544. The lower ring spring holder 506 further includes a plurality of recesses 546 in one end thereof.

The ring spring 508 comprises an annular ring spring having annular frusto-conical annular surfaces 548 therein. The ring spring 508 is retained within first bore 542 of lower ring spring holder 506 having one end thereof abutting annular shoulder 550 of holder 506 while the other end thereof abuts end 552 of upper ring spring holder 504 when the holder 504 is secured to holder 506.

OPERATION OF THE INVENTION

Referring to FIGS. 1 and 2A through 2D, to set the bridge plug 10 of the present invention a Baker Model "E-4" Wireline Pressure Setting Assembly as sold by the Baker Oil Tool Company, Houston, Tex. is used. The Baker Model "E-4" setting assembly is connected to setting sleeve 12 and adapter 14.

When the Baker Model "E-4" setting assembly is actuated, the setting assembly causes relative motion between the setting sleeve 12 and adapter 14. Initially, upon actuation of the Baker Model "E-4" setting assembly, the setting assembly pulls upwardly on the adapter 14 relative to the setting sleeve 12. Upon shearing of shear pins 318 securing packer mandrel 138 to upper wedge member 250, the upward movement by the adapter 14 causes upper movement of the retrieving J-slot retrieving mandrel 16, by-pass body 20, J-slot mandrel 120, packer mandrel 138, lower wedge member 290 and bottom coupling 380 As the lower wedge member 290 moves upwardly relative to the upper wedge member 250, the slips 300 are cammed or wedged outwardly by the upper wedge member 250 and lower wedge member 290 into engagement with the casing in the well bore.

At this point when the slips 300 engage the casing in the well bore, the Baker Model "E-4" setting assembly causes downward movement of the setting sleeve 12, ratchet body 130, and packer elements 132, relative to the retrieving J-slot mandrel 16, by-pass body 20, J-slot mandrel 120, packer mandrel 138, upper wedge member 250, lower wedge member 290 and bottom coupling 380.

This downward movement of the setting sleeve 12, ratchet body 130, and packer elements 132, causes the packer elements 132 to be compressed into engagement with the casing in the well bore and the ratchet blocks 140 to engage ratchet grooves 196 on the packer mandrel 138.

As the packer elements 132 are compressed into engagement with the casing in the well bore, the stress in the tension stud 15 increases. When the tension in tension stud 15 increases beyond a predetermined level, the stud 15 shears or fractures in the reduced diameter portion 64 of the stud 15. When the stud 15 shears or fractures, the relative movement of the various members or parts of the bridge plug 10 ceases.

When the slips 300 and the packer elements 132 engage the casing in the well bore and the tension stud 15 has sheared or severed, the ratchet blocks 140 which are engaging the ratchet grooves 196 on the packer mandrel 138 prevent any relative movement which would allow the bridge plug 10 to unset or disengage the casing in the well bore of the ratchet body 130, packer elements 132, packer mandrel case 136 and upper wedge member 250 with respect to the retrieving J-slot mandrel 16, by-pass body 20, J-slot mandrel 120, packer mandrel 138, lower wedge member 229 and bottom coupling 380.

After the tension stud 15 has sheared or severed and the bridge plug 10 has been set in the casing in the well bore, the Baker Model "E-4" setting assembly having setting sleeve 12, adapter 14 and a portion of the tension stud 15 secured thereto are removed from the well bore.

To retrieve the bridge plug 10 of the present invention the retrieving tool 500 (shown in FIG. 5) is connected to a tubing string and lowered into the casing in the well bore.

Since the setting sleeve 12 and adapter 14 are not present on the set bridge plug 10 of the present invention in the casing in the well bore, the end of the retrieving tool 500 passes over the top of the J-slot retrieving mandrel 16 with the lugs 520 of the tool 500 engaging entry portion 410 of the J-slot 72 in mandrel 16 until the ring spring 508 passes over and engages the upper surface of annular rib 88 of release valve sleeve 18.

When ring spring 508 engages annular rib 88 of release valve sleeve 18 threaded shear pins 91 retaining sleeve 18 in a first position on release valve body 20 are sheared or severed with the continued downward movement of the retrieving tool 500 causing the sleeve 18 to move downwardly until end 19 of sleeve 18 abuts shoulder 105 at body 20 at which time ring spring 508 expands slightly and passes over annular rib 88. Concurrently with this the plurality of lugs 520 in the retrieving tool 500 have moved through entry portion 410, ramp portion 412 and into lower portion 416 of J-slot 72 (see FIG. 2) in J-slot retrieving mandrel 16.

When the downward movement of the retrieving tool 500 over J-slot retrieving mandrel 16 and release valve body 20 is completed with the ring spring 508 of the resiliently engaging annular rib 88 of sleeve 18, weight is picked up and a right-hand torque is placed on the retrieving tool 500 and tubing string thereby shearing shear pin 214 engaging aperture 156 in J-slot mandrel 120 thereby allowing lug 210 on packer mandrel 138 to move into the transition portion 422 of J-slot 154 of J-slot mandrel 120.

Weight is then set down on the tubing string and retrieving tool 500 thereby causing the J-slot mandrel 120 to move downwardly relative to the packer mandrel 120 thereby, in turn, releasing the ratchet blocks 140 from engagement with ratchet groove 196 on packer mandrel 138 when second cylindrical surface 142 of J-slot mandrel 120 contacts surfaces 224 of the ratchet blocks 140 camming them outwardly from packer mandrel 138 while the studs 210 move upwardly in J-slots 154 of the J-slot mandrel 120.

During the relative movement between ratchet body 130 and packer mandrel 138 when the studs 280 are at the top of J-slots 154 of the J-slot mandrel 120, the packer mandrel 138 then moves downwardly and causes lower wedge member 290 to move downwardly thereby causing the bottom of slips 300 to be positively disengaged from the wedge member 290 and possibly from the casing in the well bore by being biased inwardly by resilient spring members 310.

To insure that the slips 300 are disengaged from the casing in the well bore and the upper wedge member 250 when weight is set down again on the bridge plug 10, this causes the locking set dogs 270 to abut first cylindrical surface 194 of packer mandrel 138 by being resiliently biased thereinto by locking set dog spring 272.

After completion of a predetermined amount of downward travel of the tubing string having retrieving tool 500 connected thereto, the tubing string and retrieving tool 500 are rotated and moved upwardly in the casing in the well bore. This rotation and upward movement causes lugs 520 on retrieving tool 500 to engage upper portion 414 (see FIG. 2) of J-slots 72 in retrieving J-slot mandrel 16 and threaded studs 210 in packer mandrel 138 to engage upper portion 420 (see FIG. 3) of J-slot 154 in packer mandrel 138.

Next, since the locking set dogs 270 now abut shoulder 402 of packer mandrel 138 while remaining in partial engagement with annular recess 404 formed between shoulder 406 of upper wedge member 250 and shoulder 408 of packer mandrel case 136, upon upward movement of the bridge plug 10 by now picking weight up on the tubing string and retrieving tool 500, the packer mandrel 138 causes the upper wedge member to be positively pulled out from under the upper frustoconical surfaces 362 of the slips 300 thereby insuring the disengagement of the slips 300 from the casing in the well bore.

At this point, continued upward movement of the tubing string and retrieving tool 500 allows the removal of the bridge plug 10 of the present invention from the casing in the well bore.

It should be noted that after release valve sleeve 18 is moved into engagement with shoulder 105 of release valve body 20 any fluid pressure differential across the bridge plug 10 may be equalized by fluid flowing through the bores of bottom coupling 380, packer mandrel 138, J-slot mandrel 120, release valve body 20 through apertures 118 therein, and retrieving tool 500 through apertures 522 therein.

It will be understood that the foregoing disclosure and description of the bridge plug of the present invention are illustrative and explanatory thereof, and various modifications and changes in size, shape and materials as well as details of the illustrated construction may be made without departing from the scope of the invention.

Illustrations of such modifications and changes in the bridge plug 10 of the present invention are integrating or combining the ratchet blocks 140 and ratchet body 130 such that the ratchet body 130 has a plurality of interiorly threaded resilient collet fingers on one end thereof to engage ratchet thread 196 on packer mandrel 138, or integrating or combining the packer mandrel case 136 and upper wedge member 250 into an elongated packer wedge case or integrating or combining the lower wedge member 290, packer mandrel 138 and lower coupling 380 into one member, or by rearranging the order of the components of the bridge plug, etc.

Also, the bridge plug 10 of the present invention could be utilized as a packer by changing the release valve sleeve 18 to a different type actuated valve to permit the selective flow of fluids through the packer.

Having thus described our invention, we claim:

1. A retrievable well tool for use in well bores, said retrievable well tool comprising:

a first mandrel having at least one shaped recess in one end thereof;

a packer mandrel having a plurality of apertures therein, at least one lug extending inwardly therefrom to engage the shaped recess in the first mandrel and ratchet grooves on a portion thereof;

a ratchet body having a portion thereof adapted to releasably engage the ratchet grooves on the packer mandrel, the ratchet body being disposed about the packer mandrel;

a packer element disposed about the packer mandrel, the packer element adapted to releasably, resiliently engage said well bore;

a packer mandrel case disposed about a portion of the packer mandrel;

an upper wedge member disposed about the packer mandrel and having a frusto-conical surface on a portion of the exterior thereof;

a lower wedge member disposed about a portion of the packer mandrel having a frusto-conical surface on a portion of the exterior thereof; and a plurality of slips disposed about a portion of the packer mandrel being axially located between the upper wedge member and the lower wedge member.

2. The well tool of claim 1 wherein the mandrel comprises:

a slip retainer sleeve having a portion thereof disposed about the upper wedge member, having a plurality of apertures therein to permit a portion of each slip of the plurality of slips to extend therethrough, and a portion thereof disposed about the lower wedge member;

a plurality of slip springs, each slip spring of the plurality having a portion thereof engaging a slip of the plurality of slips and a portion of the slip retainer sleeve to resiliently bias the plurality of slips out of engagement with said well bores;

a J-slot mandrel having at least one shaped recess therein; and a by-pass body connected to the J-slot mandrel.

3. The well tool of claim 1 further comprising:

a release sleeve valve releasably, slidably retained on the mandrel.

4. The well tool of claim 3 wherein the tool further comprises:

a packer mandrel case connected to the packer mandrel and the upper wedge member; and a bottom coupling connected to one end of the packer mandrel.

5. The well tool of claim 4 further comprising:

an adapter having a first bore through a portion thereof and a second bore through another portion thereof;

a tension stud having a portion thereof connected to the adapter and another portion connected to the by-pass body; and at least one shear pin to releasably retain the packer mandrel and the upper wedge member in a first position with respect to each other.

6. The well tool of claim 5 further comprising:

a setting sleeve adapted for use when setting said well tool in said well bores.

7. The well tool of claim 6 further comprising:

a retrieving tool adapted for use in retrieving said well tool from said well bores.

8. The well tool of claim 6 wherein the setting sleeve comprises:

an elongated annular member

9. The well tool of claim 7 wherein the retrieving tool comprises:

an elongated annular member having at least one lug therein adapted to releasably engage the shaped recess in the mandrel.

10. A retrievable bridge plug for use in well bores, said retrievable bridge plug comprising:

a first mandrel having at least one shaped recess in one end thereof;

a packer mandrel having a plurality of apertures therein, at least one lug extending inwardly therefrom to engage the shaped recess in the first mandrel and ratchet grooves on a portion thereof;

a ratchet body having a portion thereof adapted to releasably engage the ratchet grooves on the packer mandrel, the ratchet body being disposed about the packer mandrel;

a packer element disposed about the packer mandrel, the packer element adapted to releasably, resiliently engage said well bore;

a packer mandrel case disposed about a portion of the packer mandrel;

an upper wedge member disposed about the packer mandrel and having a frusto-conical surface on a portion of the exterior thereof;

a lower wedge member disposed about a portion of the packer mandrel having a frusto-conical surface on a portion of the exterior thereof;

a plurality of slips disposed about a portion of the packer mandrel being axially located between the upper wedge member and the lower wedge member;

a slip retainer sleeve having a portion thereof disposed about the upper wedge member, having a plurality of apertures therein to permit a portion of each slip of the plurality of slips to extend therethrough, and a portion thereof disposed about the lower wedge member; and a plurality of slip springs, each slip spring of the plurality having a portion thereof engaging a slip of the plurality of slips and a portion of the slip retainer sleeve to resiliently bias the plurality of slips out of engagement with said well bores.

11. The bridge plug of claim 10 wherein the mandrel comprises:

a J-slot mandrel having at least one shaped recess therein; and a by-pass body connected to the J-slot mandrel.

12. The bridge plug of claim 10 further comprising:

a release sleeve valve releasably, slidably retained on the mandrel.

13. The bridge plug of claim 12 further comprising:

a packer mandrel case connected to the packer mandrel and the upper wedge member; and a bottom coupling connected to one end of the packer mandrel.

14. The bridge plug of claim 13 further comprising:

an adapter having a first bore through a portion thereof and a second bore through another portion thereof; and a tension stud having a portion thereof connected to the adapter and another portion connected to the by-pass body.

15. The bridge plug of claim 14 further comprising:

a setting sleeve adapted for use when setting said well tool in said well bores.

16. The bridge plug of claim 15 further comprising:

a retrieving tool adapted for use in retrieving said well tool from said well bores.

17. The bridge plug of claim 15 wherein the setting sleeve comprises:

an elongated annular member.

18. The bridge plug of claim 15 wherein the retrieving tool comprises:

an elongated annular member having at least one lug therein adapted to releasably engage the shaped recess in the mandrel.

19. The bridge plug of claim 14 further including:

at least one shear pin to releasably retain the packer mandrel and the upper wedge member in a first position with respect to each other.

20. A wireline settable, tubing retrievable bridge plug for use in well bores, said retrievable bridge plug comprising:

a first mandrel having at least one shaped recess in one end thereof;

a packer mandrel having a plurality of apertures therein, at least one lug extending inwardly therefrom to engage the shaped recess in the first mandrel and ratchet grooves on a portion thereof;

a ratchet body having a portion thereof adapted to releasably engage the ratchet grooves on the packer mandrel, the ratchet body being disposed about the packer mandrel;

a packer element disposed about the packer mandrel, the packer element adapted to releasably, resiliently engage said well bore;

a packer mandrel case disposed about a portion of the packer mandrel;

an upper wedge member disposed about the packer mandrel and having a frusto-conical surface on a portion of the exterior thereof;

a lower wedge member disposed about a portion of the packer mandrel having a frusto-conical surface on a portion of the exterior thereof;

a plurality of slips disposed about a portion of the packer mandrel being axially located between the upper wedge member and the lower wedge member;

a slip retainer sleeve having a portion thereof disposed about the upper wedge member, having a plurality of apertures therein to permit a portion of each slip of the plurality of slips to extend therethrough, and a portion thereof disposed about the lower wedge member;

a plurality of slip springs, each slip spring of the plurality having a portion thereof engaging a slip of the plurality of slips and a portion of the slip retainer sleeve to resiliently bias the plurality of slips out of engagement with said well bores;

a release sleeve valve releasably, slidably retained on the mandrel;

a packer mandrel case connected to the packer mandrel and the upper wedge member;

a bottom coupling connected to one end of the packer mandrel;

an adapter having a first bore through a portion thereof and a second bore through another portion thereof; and a tension stud having a portion thereof connected to the adapter and another portion connected to the by-pass body.

* * * * *